US005413019A

United States Patent [19]

Blanda, Jr.

[11] Patent Number: 5,413,019

[45] Date of Patent: May 9, 1995

[54] GUITAR TREMOLO APPARATUS

[75] Inventor: George F. Blanda, Jr., Aliso Viejo, Calif.

[73] Assignee: Fender Musical Instruments Corporation, Scottsdale, Ariz.

[21] Appl. No.: 68,654

[22] Filed: May 26, 1993

[51] Int. Cl.[6] ..... G10D 3/00

[52] U.S. Cl. ..... 84/298; 84/313

[58] Field of Search ..... 84/297 R, 298, 307, 84/313

[56] References Cited

U.S. PATENT DOCUMENTS

| | | | |
|---|---|---|---|
| 2,741,146 | 4/1956 | Fender | 84/313 |
| 3,143,028 | 8/1964 | Fender | 84/293 |
| 4,608,906 | 9/1986 | Takabayashi | 84/313 |
| 4,681,010 | 7/1987 | Wilkinson | 84/298 |
| 4,724,737 | 2/1988 | Fender | 84/313 |
| 4,763,555 | 9/1988 | Minakuchi et al. | 84/313 |
| 4,882,967 | 11/1989 | Rose | 84/313 |
| 4,967,631 | 11/1990 | Rose | 84/313 |

*Primary Examiner*—M. L. Gellner
*Assistant Examiner*—Patrick J. Stanzione
*Attorney, Agent, or Firm*—Richard L. Gausewitz

[57] ABSTRACT

An apparatus by which both tremolo action and string clamping and string intonation adjustment are achieved effectively and in a very small space. Adjustment screw shanks are threaded into bores in the inertia bar or block of the tremolo, and bear against the heads of pull screws that are connected to string-clamping saddles. The heads of the pull screws are received in recesses in the inertia bar; the inertia bar is connected to the bridge plate by several screws that do not interfere with the screw shanks. To adjust intonation, the bridge plate is pivoted upwardly and a wrench is employed to rotate the screw shanks, which in turn bear against the heads of the pull screws. Furthermore, the pull screws are rotated to release positions while the bridge plate is in its upwardly-pivoted position. After intonation is adjusted, the pull screws are rotated to lock the saddles in their desired positions.

21 Claims, 3 Drawing Sheets

3/3

GUITAR TREMOLO APPARATUS

BACKGROUND OF THE INVENTION

Since Leo Fender's creation of the "Stratocaster" (trademark) guitar in mid-century, vast numbers of these guitars (and copies of them) have been sold throughout the world. In addition, there have been sold throughout the world large numbers of string-clamping tremolo devices that were invented by Floyd Rose. It is greatly desired to create a compact tremolo apparatus whereby the tremolo may be fitted or retrofitted into the conventional body opening of Stratocaster guitars, and which has certain string-clamping features of tremolos invented by Floyd Rose, and has adequate and easily operated string-length adjustment for intonation purposes, and is practical and economical.

SUMMARY OF THE INVENTION

Applicant has solved the problem of creating a retrofittable tremolo for existing (and original equipment) Stratocaster guitars, and which has the above-indicated string clamping and intonation adjustment.

Adjustment elements are threaded into the inertia bar (block) of the tremolo apparatus, and are adapted when turned to pull the string saddles to desired longitudinal positions; conversely, the adjustment elements are adapted to progressively reduce the pulling forces on the saddles so that they may be shifted by string tension toward the head of the guitar.

The saddles are string-clamping saddles, in the preferred embodiment.

The adjustment elements are screw shanks that can be turned by wrenches when the bridge plate is pivoted upwardly sufficiently far. The tail ends of the screw shanks bear against the heads of upwardly-extending pull screws that extend through bridge-plate slots into the saddles. Above the upper ends of the pull screws are clamping screws that bear against string clamp elements and thus pinch or clamp the string ends. Other screws adjust the height of the bridge plate and thus of the strings. The upwardly-extending pull screws are adapted to be rotated, when the bridge plate is pivoted upwardly sufficiently far, by a wrench so as to lock the saddles in desired positions at which the intonation is correct.

The inertia bar is not connected to the bridge plate by the usual few large screws. Instead, such connection is effected by more small screws, and these are so spaced as to prevent interference with the screw shanks. Upper regions of the bar are recessed to receive portions of the screw shanks, and also of the heads of the pull screws.

DETAILED DESCRIPTION OF THE PREFERRED EMBODIMENT

Figure 1:
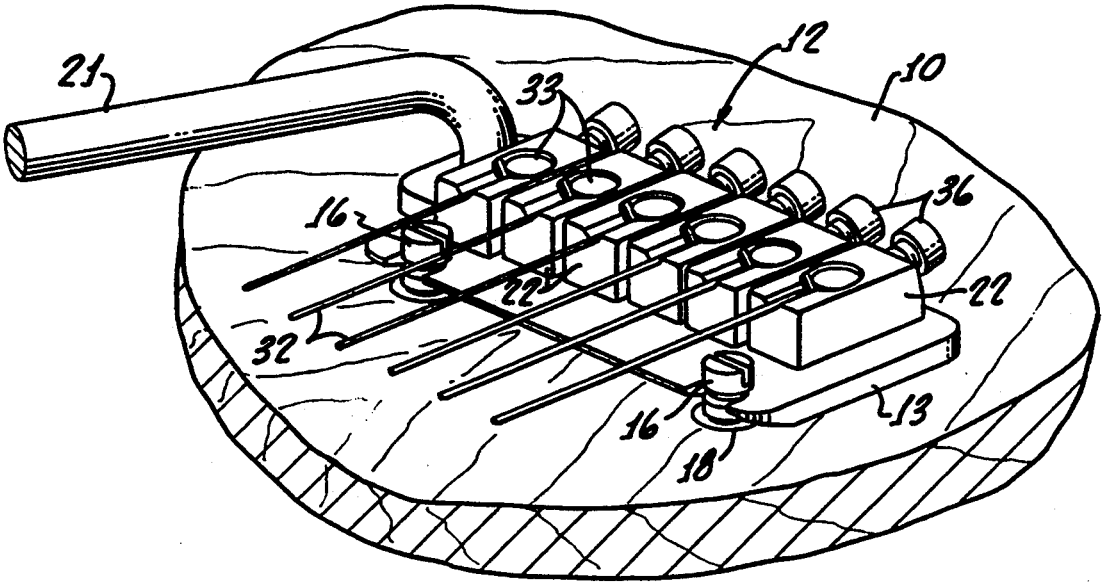
FIG. 1 is an isometric view showing the tremolo as mounted on a guitar body that is shown fragmentarily.

The present compact tremolo may be combined with various types and brands of guitars, but is particularly adapted to be combined with a "Stratocaster" (trademark) guitar such as is shown and described in U.S. Pat. No. 2,741,146. Said patent is hereby incorporated by reference herein, as is U.S. Pat. No. 3,143,028. The latter patent shows the full length of the neck of an electric guitar, including the bridge ("nut") at the junction between the outer end of the neck and the inner end of the head of the guitar.

The present electric guitar has substantially the construction of U.S. Pat. No. 2,741,146, but with substantially the neck of U.S. Pat. No. 3,143,028, and with the major change that the tremolo described in the present application is substituted for that described in U.S. Pat. No. 2,741,146.

The solid wooden body of the present guitar is indicated at 10, having formed therein a deep slot or recess 11 that is adapted to receive the lower portions of the tremolo apparatus 12.

Tremolo 12 comprises a bridge plate (base plate) 13 that is relatively thick except at two fulcrum recesses 14 (FIG. 2) at the front edge thereof. The fulcrum recesses receive fulcrum screws or posts 16 having annular grooves 17 therein. The posts are threaded into bushings 18 that in turn are anchored in body 10. The posts are adapted to be vertically adjusted in order to regulate the height of bridge plate 13 and thus of the guitar strings. The relationships are such that bridge plate 13 overlaps the upper end of slot or recess 11, and is generally parallel to the face of the guitar body.

Figure 5:
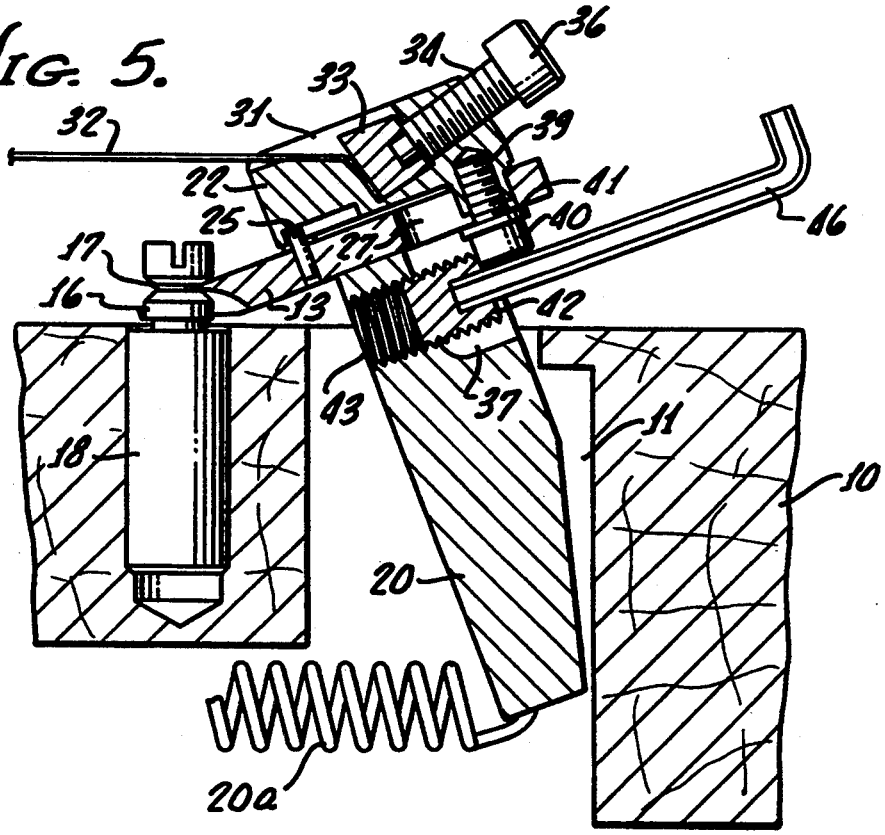
FIG. 5 is a fragmentary vertical sectional view illustrating the method step of adjusting string length.

An inertia bar or block 20 is connected to the underside of bridge plate 13 perpendicularly thereof, and extends downwardly into recess 11. At its lower end, the bar or block is connected to tension springs **20*a* which extend toward the neck of the guitar and are secured to body 10, for example as shown in the cited U.S. Pat. No. 2,741,146. The tail side of the lower portion of bar 20 is beveled in order to permit a relatively large degree of upward pivoting of bridge plate 13, as shown in FIG. 5. Such pivoting, and all pivotal movements of the tremolo, are effected by a control arm 21 that extends through one lateral edge portion of plate 13**, and that corresponds generally to the control arm shown in the U.S. Pat. No. 2,741,146.

Figure 2:
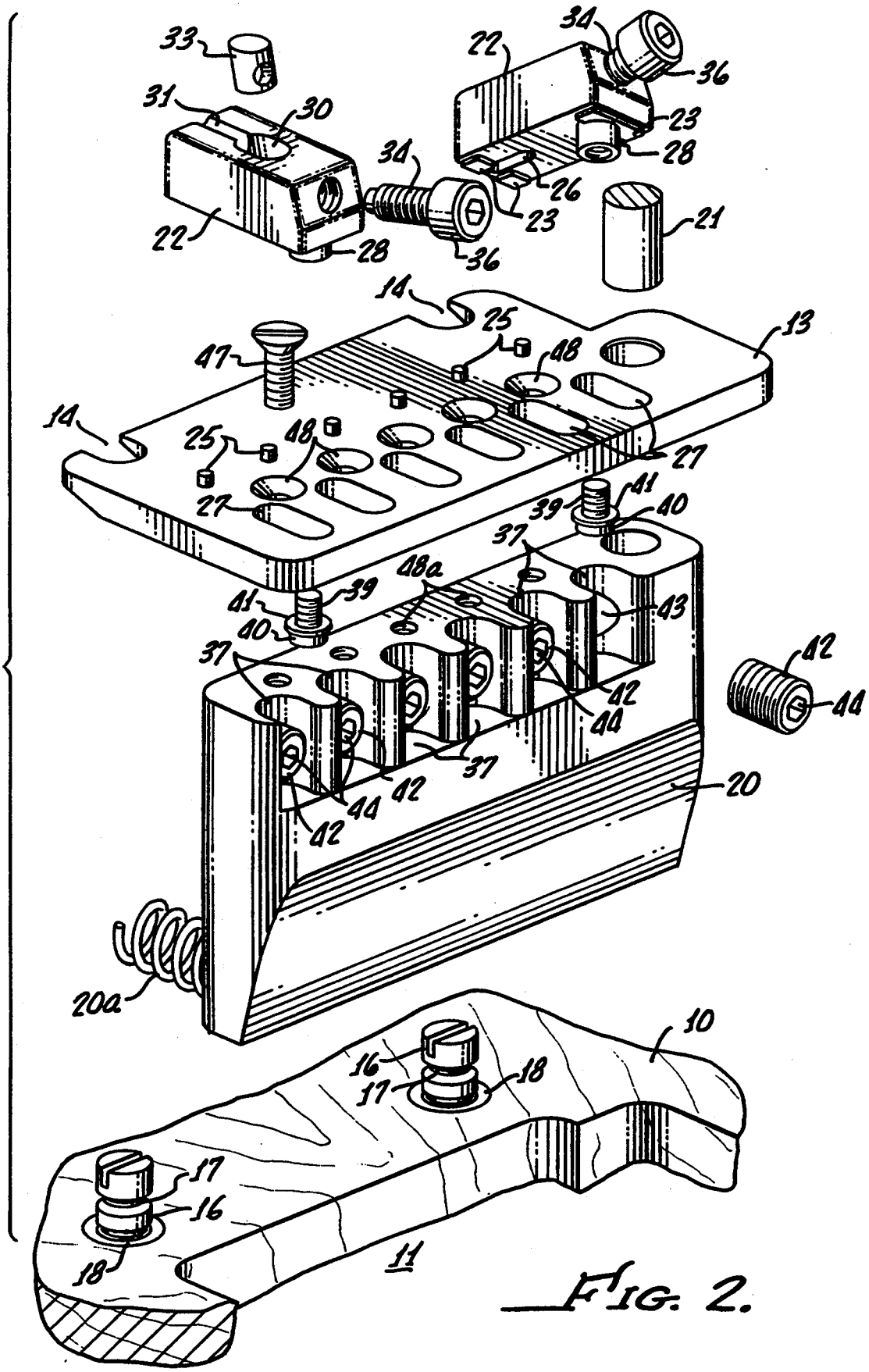
FIG. 2 is an exploded view of the tremolo and a portion of the guitar body.

Six substantially identical string-engaging elements, namely saddles 22, are mounted on the upper surface of bridge plate 13 for sliding movement toward and away from the head of the guitar. As shown in FIG. 2, each saddle has feet 23 that rest on bridge plate 13.

Figure 3:
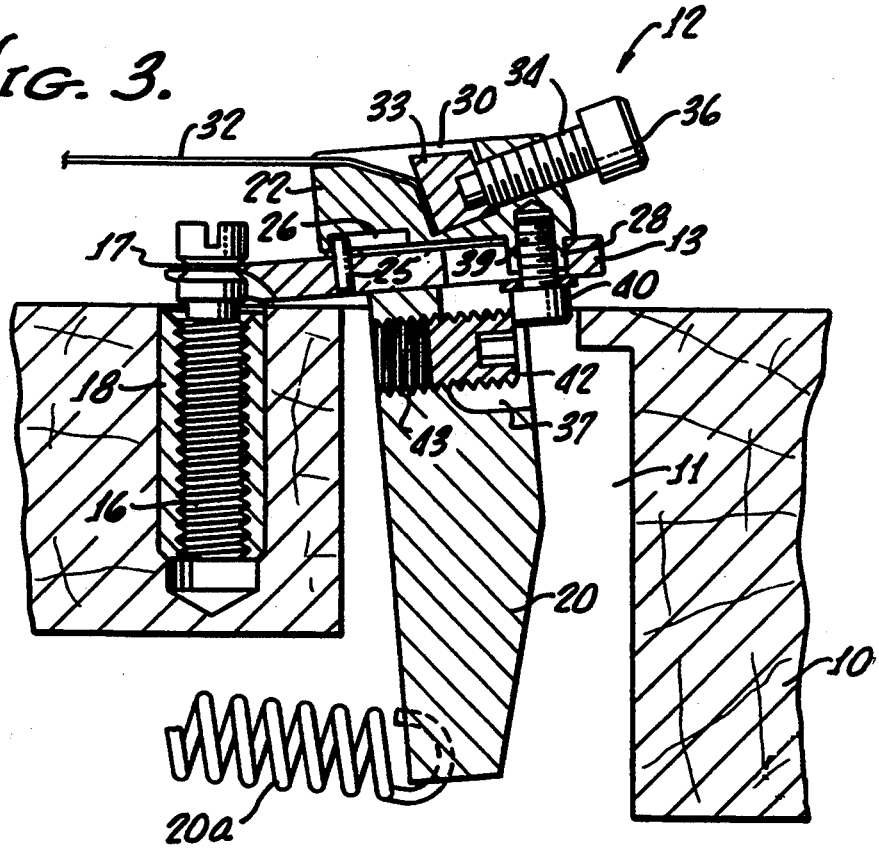
FIG. 3 is a fragmentary vertical sectional view showing the tremolo in its free or rest condition, and indicating a guitar string at substantially maximum length.

Means are provided to maintain the six saddles 22 parallel to each other and in laterally-spaced relationship relative to each other at all times, the saddles being elongate in a direction longitudinal to the neck (center line) of the guitar. For each saddle 22, the first such means is a vertical pin 25 that is anchored in plate 13, the upper pin end extending into a longitudinal groove 26 (FIG. 3) in the underside of the saddle. Groove 26 is sufficiently long to permit the full adjustment allowed by the means described in the following paragraph.

The second means for maintaining saddles 22 parallel to each other, and which is part of the mechanism for performing the crucial function of pulling on the strings, is (for each saddle) a wide slot 27 extending through plate 13 at the tail edge portion thereof. Slots 27 are parallel to each other and to the neck (center line) of the guitar. Each slot 27 receives in close-fitting but slidable relationship a cylindrical vertical tube 28 that is interiorly threaded, and is preferably integral with the associated saddle 22, and extends downwardly from the tail end thereof. The amount of projection of tube 28 into the associated slot 27 is somewhat less than the thickness of plate 13, so that the bottom tube end does not reach the plane of the bottom surface of the bridge plate.

The remaining portion of each saddle 22 is a combination string-clamping and bridge means. A relatively deep recess 30 is formed in the upper region of each saddle 22 (FIGS. 2 and 3), and communicates with a groove 31 that extends toward the guitar head. The bottom wall of such groove, at a point relatively near the head end of the saddle, is a bridge region for an associated string 32. The tail end of the string extends along the groove 31 and down to the bottom of recess 30, and is pinched by a cylindrical clamp block 33 which fits into the recess 30 with sufficient clearance to make room for the string end.

A clamping screw 34 is threaded through an inclined bore in the tail end of each saddle, and has a reduced-diameter cylindrical inner end that seats rotatably in a cylindrical recess in each block 33. Each clamping screw has an Allen head 36 which permits very high-force tightening of block 33 against the string end which, in turn, is clamped very tightly against the forward wall of recess 30. Block 33 and saddle 22 are formed of hard steel. The described clamping relationship maintains the end of each of the six strings of the guitar fixedly clamped to an associated saddle despite the presence of numerous forces such as, for example, result from bending of the guitar strings 32 (bending of notes).

Figure 4:
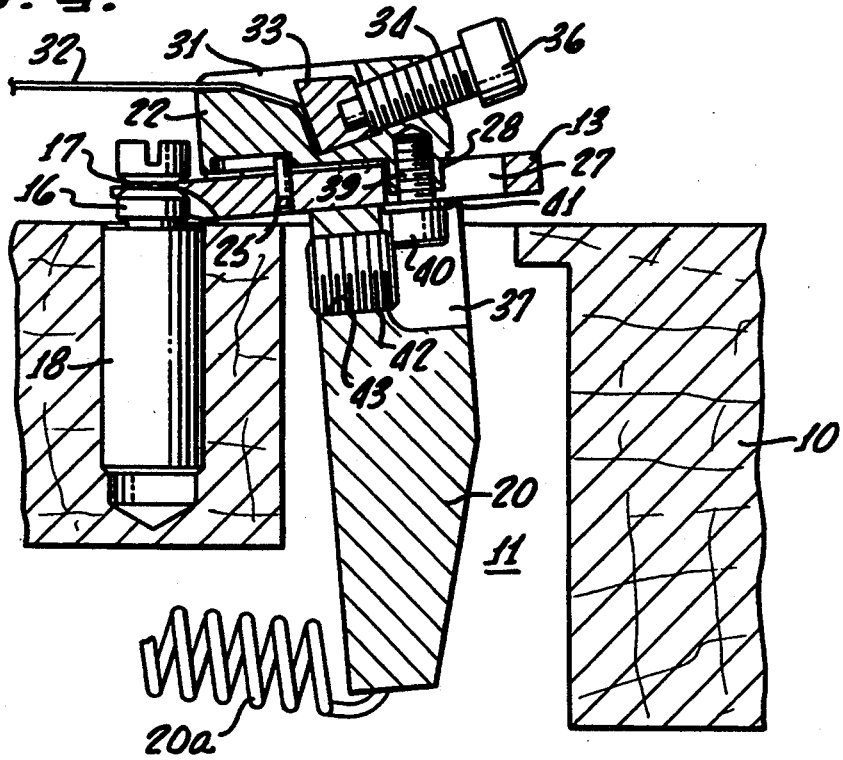
FIG. 4 is a view corresponding to FIG. 3 but showing the guitar string at substantially minimum length.

Adjustment means are provided to shift the various saddles 22 longitudinally of the guitar, to thus vary string length for intonation (or other) purposes. For each wide slot 27 in bridge plate 13, there is formed in the upper-rear region of inertia bar 20 a recess 37 (FIG. 2). Each recess 37 is sufficiently deep to permit full travel of associated screws, as described subsequently. Thus, for example, the forward (closest to the neck) wall of each recess is sufficiently far forward to permit adjustment of the saddle to the substantially full-forward position of FIG. 4. Recesses 37 are also sufficiently wide to prevent any interference with the below-described adjustment screws.

A pull screw 39, which is also a locking screw, is threaded upwardly into and through each cylindrical vertical tube 28, and also into the body of the saddle 22 above such tube 28 in order to provide a very strong connection. Such screw, and the threaded bore therefor, do not extend upwardly sufficiently far to interfere with the associated clamping screw 34.

Each screw 39 has an Allen head 40, at the lower end of the screw shank and disposed in a recess 37. A washer 41 is provided between the Allen head 40 and the under surface of bridge plate 13, to permit strong tightening of the pull screw 39 in order to lock the associated saddle 22 at any desired adjusted position along the length of a wide slot 27. Such length of each slot 27 is sufficient to permit saddle adjustment, when it is not locked, between the substantially extreme positions shown in FIGS. 4 and 5.

To provide an extremely compact mechanism for moving each pull screw 39, and thus tube 28 and saddle 22, longitudinally of the associated slot 27, a large-diameter screw shank (slug) 42 is threaded into a horizontal internally-threaded bore 43 that is formed in the inertia bar (FIG. 5) at the bottom of each recess 37. The diameter of each shank 42, and the vertical position of bore 43, are so correlated to the position of Allen head 40 of pull screw 39 that the upper peripheral edge region of the shank engages such Allen head, but the Allen head 40 does not block an Allen opening 44 in shank 42 (FIGS. 2 and 5). Furthermore, the positioning of the screw shank 42, and of the Allen head 40 of pull screw 39, are such that both may be operated by an angular Allen wrench 46 (FIG. 5) when the control arm 21 of the tremolo 12 is pushed downwardly sufficiently far to pivot bridge plate 13 upwardly to the position of FIG. 5.

It is to be understood that in conventional tremolo devices the inertia bar is secured to the bridge plate by a small number (for example, 3) of relatively large screws. In the present tremolo, on the other hand, a greater number (for example, five) of smaller-diameter screws are employed to secure the inertia bar to the bridge plate. One such screw is shown in FIG. 2 and is numbered 47. The holes for the five screws 47 are indicated at 48 and 48*a* in FIG. 2, being positioned between and forwardly of the wide slots 27 so as not to interfere with adjustment of the positions of the saddles, while still maintaining the strength of the plate-inertia bar connection.

DESCRIPTION OF THE METHOD

Let it be assumed that a guitarist owns a "Stratocaster" (trademark) guitar such as the one shown in the U.S. Pat. No. 2,741,146. To replace the tremolo shown in such patent with the one described in the present application, the technician removes the screws 16 shown in such patent and replaces them with bushings 18 and screws 16 described above. Then, the present tremolo is dropped into the slot or recess 11, with the sharp edges at fulcrum recesses 14 engaging the bottoms of grooves 17. The springs 20*a* at the bottom of inertia bar 20 are connected to the guitar body, and the six strings 32 are clamped as described above and are also connected to the tuning screws (tuning machines) on the head of the guitar. The tension relationships are caused to be such that, when no force is supplied to control arm 21, bridge plate 13 is at substantially the angle shown in FIGS. 3 and 4. This is done when all the strings are tuned to correct pitch.

To adjust the intonation of any string, the wrench 46 (FIG. 5) is used to loosen somewhat the pull screw 39,40 for that string, the amount of loosening being just sufficient to permit longitudinal movement of the saddle 22 in response to string tension, or in response to rotation of the associated screw shank 42.

The string 32 is then pressed lightly at a point above the twelfth fret, so that the string does not touch the fret. The string is then plucked at its region between the twelfth fret and the bridge, following which the pressing on the string is immediately terminated. This generates the second harmonic. The pitch of the second harmonic is then retained by the musician in his or her head, or in a tuning meter. Thereafter, the string is pressed hard against the twelfth fret and again plucked. It is then determined whether or not the pitch resulting from the last-mentioned plucking is the same as that of the previously-determined second harmonic. If it is, the intonation is correct and nothing remains to be done except to employ wrench 46 to tighten pull screw 39,40.

The loosening or tightening of the pull screw 39,40 is done while the tail edge of bridge plate 13 is pivoted upwardly (by downward pressing on the control arm) to approximately the position shown in FIG. 5.

Assuming, however, that the intonation is not correct, the pull screw 39,40 is not tightened. Instead, wrench 46 is employed as illustrated in FIG. 5 (with the bridge plate pivoted upwardly) to rotate screw shank 42 and thus shift the saddle 22 a small amount in a direction that either lengthens or shortens the string, as appropriate. As above indicated, the saddle moves either in response to string tension (when shank 42 is threaded to the left) or in response to rightward pressure against screw head 40 (when shank 42 is threaded to the right). After this occurs, the associated tuning screw on the guitar head is employed to bring the string 32 to the correct pitch. Then, the above-described twelfth-fret procedure is repeated to see whether or not the second harmonic has the same pitch as that which is generated when the string is pressed tightly against the twelfth fret. If so, wrench 46 is employed to tighten pull screw 39,40. If not, the screw shank 42 is again employed to shift the saddle in the appropriate direction and the fretting procedure is repeated.

It is possible to replace the washer 41 of each pull screw 39,40 with a resilient steel washer that is somewhat frustoconical (belleville spring). Then, each pull screw is never fully tightened. This, however, is not the preferred construction.

The nut between the head and neck of the instrument is caused to be very low in friction. Thus, for example, the nut may be a roller, may be formed of graphite, etc. It is preferred that the nut be a roller. It is preferred that the strings not be clamped at the nut.

The heights of the various saddle bodies are caused to be different, in such manner that the six strings 22 will lie substantially on the surface of large-diameter imaginary cylinder, the axis of such cylinder lying in a plane that contains the center line of the guitar and is perpendicular to the guitar body. Furthermore, the axis of the imaginary cylinder is parallel to the center line of the guitar and is spaced far below the guitar neck.

The present tremolo (and guitar-tremolo combination) achieves an accurate zeroing after the control arm 21 is released. In other words, each string then returns to the same pitch it had when tremolo action was started.

A preferred diameter for each adjustment screw 42 is ¼ inch, which is relatively large.

The foregoing detailed description is to be clearly understood as given by way of illustration and example only, the spirit and scope of this invention being limited solely by the appended claims.

What is claimed is:

1. Bridge apparatus for guitars, which comprises:

(a) a bridge plate, (b) means to mount said bridge plate over and in proximity to the face of a guitar body, (c) a plurality of string-engaging elements movably mounted on the upper surface of said bridge plate, and (d) means mounted beneath said bridge plate to effect controlled individual movements of each of said string-engaging elements relative to said bridge plate to thereby individually affect the conditions of guitar strings associated with said string-engaging elements.

2. A guitar tremolo apparatus adapted to be mounted on the body of a guitar, which comprises:

(a) a bridge plate, (b) means to pivotally mount said bridge plate over the face of a guitar body, (c) a plurality of string-engaging elements mounted movably on the upper side of said bridge plate,
each of said string-engaging elements being adapted when moved to adjust the condition of a guitar string associated therewith, (d) means including spring means to connect said bridge plate to said guitar body to counteract the forces of said strings, (e) a control arm connected to said bridge plate to pivot the same away from a neutral position at which it rests in response to the forces created on said bridge plate by said spring means and by said strings, (f) a plurality of adjustment elements movably mounted beneath said bridge plate,
said adjustment elements being adapted to be individually manually moved while said bridge plate is mounted on a guitar body, and (g) means to associate each of said adjustment elements with one of said string-engaging elements, in such manner that when one of said adjustment elements is thus moved the condition of an associated guitar string will be altered.

3. The invention as claimed in claim 2, in which means are provided on each of said string-engaging elements to clamp the end of a guitar string.

4. The invention as claimed in claim 3, in which said tremolo apparatus is combined with an electric guitar having said body, and in which the strings of said guitar are clamped at their inner ends to said respective string-engaging elements.

5. The invention as claimed in claim 4, in which said guitar strings extend, at their outer end portions, over the nut of said guitar, said nut being a low-friction type, said strings not being clamped at said nut.

6. A guitar tremolo apparatus adapted to be mounted on the body of a guitar, said body having a slot or recess therein to receive a portion of said tremolo apparatus, which comprises:

(a) a bridge plate, (b) a bar connected transversely to the underside of said bridge plate and extending downwardly therefrom for a substantial distance,
said bar being adapted to extend downwardly into a slot or recess in the body of a guitar, the relationships being such that when said bar so extends said bridge plate will be in proximity to the face of said guitar body, (c) means to pivotally mount said bridge plate to said guitar body, (d) a plurality of string-engaging elements mounted movably on the upper side of said bridge plate,
each of said string-engaging elements being adapted when moved to adjust the condition of a guitar string associated therewith, (e) spring means adapted to connect said bar to said guitar body to counteract the tensions of said strings, (f) a control arm connected to said bridge plate to pivot the same away from a neutral position at which it rests in response to forces created by said spring means and by said strings, (g) a plurality of adjustment elements movably mounted beneath said bridge plate, said adjustment elements being adapted to be individually manually moved while said tremolo apparatus is mounted on a guitar body, and (h) means to associate each of said adjustment elements with one of said string-engaging elements, in such manner that when one of said adjustment elements is thus moved a part of an associated guitar string will also move to alter the condition of such associated guitar string.

7. The invention as claimed in claim 6, in which said adjustment elements are threaded elements that are threadedly associated with said bar.

8. The invention as claimed in claim 7, in which said means to associate said adjustment elements with said string-engaging elements are pull elements that extend downwardly from said string-engaging elements for respective engagement by said threaded elements.

9. The invention as claimed in claim 8, in which said bar is thick and heavy, and is recessed at its end portion nearest said bridge plate in order to receive portions of said pull elements and of said threaded elements.

10. The invention as claimed in claim 6, in which said adjustment elements are threaded elements that are threadedly associated with said bar and in which said means to associate said adjustment elements with said string-engaging elements are pull elements that extend downwardly from said string-engaging elements for respective engagement by said threaded elements, and in which each of said threaded elements is a large-diameter screw shank, each screw shank being so disposed that an upper peripheral end-edge thereof is forwardly adjacent the lower end of one of said pull elements.

11. The invention as claimed in claim 10, in which there are no heads on said shanks, and in which the tail end of each shank is adapted to be engaged and turned by a wrench while the tail edge of said bridge plate is in upwardly-pivoted condition spaced from the face of the guitar body.

12. The invention as claimed in claim 6, in which each of said pull elements is a screw threaded upwardly into one of said string-engaging element.

13. The invention as claimed in claim 12, in which each of said screws extends through a slot in said bridge plate, each slot extending parallel to each other slot, and in which the lower end of each such screw is a head that is adapted to be turned by a wrench when the tail end of said bridge is in upwardly-pivoted position spaced from the face of the guitar body.

14. The invention as claimed in claim 13, in which each screw head is adapted when tightened to lock the associated string-engaging element to said bridge plate.

15. The invention as claimed in claim 6, in which each of said string-engaging elements is an elongate saddle extending parallel to the other saddles and adapted to be parallel to the center line of the guitar when the tremolo apparatus is mounted on a guitar body.

16. The invention as claimed in claim 15, in which each of said saddles is a string-clamping bridge saddle having a recessed upper portion in which is inserted a string-clamping block, and in which clamp screw means are threaded through said respective saddles to engage said blocks and thereby clamp guitar string ends in said respective saddles.

17. The invention as claimed in claim 16, in which alignment means are provided to maintain said saddles parallel to each other.

18. The invention as claimed in claim 17, in which said alignment means includes pin-and-groove means to slidably associate said saddles with said bridge plate.

19. The invention as claimed in claim 17, in which said alignment means includes parallel slots in said saddles, and tubes extending downwardly from said saddles into said slots and being substantially as large in diameter as the width of said slots.

20. The invention as claimed in claim 19, in which said tubes do not extend below said slots, and in which pull screws are extended upwardly into said tubes and threadedly associated therewith.

21. A compact guitar bridge apparatus with concealed means to shift the bridge saddles through small increments of distance, said bridge apparatus comprising:

(a) a bridge plate, (b) a plurality of string saddles mounted movably on the upper side of said plate, (c) screw-receiving means provided on the lower side of said plate, said screw-receiving means having a plurality of threaded openings therein, the axes of said threaded openings being generally parallel to each other and generally parallel to said plate, (d) a plurality of screws threadedly mounted in said threaded openings, and (e) pull means provided on said respective string saddles and extending downwardly therefrom into the paths of said screws whereby to be engaged and moved by said screws when they are turned, said screws being large in diameter, being headless, and having Allen openings in ends thereof, said pull means having lower ends disposed to be engaged by only the peripheries of said screws, radially outwardly from said Allen openings, said Allen openings not being in line with said pull means, and not being blocked thereby.

* * * * *